US011278936B2

(12) United States Patent
Beaugrand et al.

(10) Patent No.: US 11,278,936 B2
(45) Date of Patent: Mar. 22, 2022

(54) MAIL SORTING INSTALLATION WITH A SHUTTLE ROBOT FOR INJECTING TRAYS ONTO A CONVEYOR

(71) Applicant: SOLYSTIC, Bagneux (FR)

(72) Inventors: Wilfrid Beaugrand, Valence (FR); Cedric Milord, Marches (FR); Patrick Tetaz-Receveur, Saint Romans (FR); Laurent Pellegrin, Livron (FR)

(73) Assignee: SOLYSTIC, Bagneux (FR)

( * ) Notice: Subject to any disclaimer, the term of this patent is extended or adjusted under 35 U.S.C. 154(b) by 504 days.

(21) Appl. No.: 16/339,176

(22) PCT Filed: Dec. 12, 2018

(86) PCT No.: PCT/FR2018/053220
§ 371 (c)(1),
(2) Date: Apr. 3, 2019

(87) PCT Pub. No.: WO2019/158829
PCT Pub. Date: Aug. 22, 2019

(65) Prior Publication Data

US 2021/0354174 A1 Nov. 18, 2021

(30) Foreign Application Priority Data

Feb. 13, 2018 (FR) ..... 1851194

(51) Int. Cl.
*B07C 3/00* (2006.01)
*B07C 3/08* (2006.01)

(52) U.S. Cl.
CPC ..... *B07C 3/008* (2013.01); *B07C 3/082* (2013.01)

(58) Field of Classification Search
CPC B07C 3/082; B07C 3/008; B07C 5/00; B07C 5/34
USPC ..... 209/552
See application file for complete search history.

(56) References Cited

U.S. PATENT DOCUMENTS 6,953,906 B2 * 10/2005 Burns ..... B07C 1/02 198/347.1
9,845,194 B2 * 12/2017 Chirol ..... B65G 1/1378
2017/0354994 A1 * 12/2017 Stratton ..... B07C 5/38

FOREIGN PATENT DOCUMENTS

FR 2 940 149 A1 6/2010
FR 3 040 900 A1 3/2017
FR 3040900 A1 * 3/2017 ..... G05D 1/0011
WO 01/12348 A1 2/2001

(Continued)

*Primary Examiner* — Gene O Crawford
*Assistant Examiner* — Muhammad Awais
(74) *Attorney, Agent, or Firm* — Ware, Fressola, Maguire & Barber LLP

(57) ABSTRACT

The sorting installation (1) of the invention includes sorting outlets (2) aligned along a sorting conveyor (3), each outlet being provided with a recess (4) for receiving a tray (5) in which sorted mailpieces (6) are stored. The installation also includes a tray conveyor (8) that extends in a certain conveying direction (F2) under the sorting outlets for the purpose of transporting trays filled with sorted mailpieces from the sorting outlets to a feed inlet (7) of the sorting conveyor. The installation further includes a shuttle robot (9) suitable for traveling on the floor (S1) in autonomous manner along the sorting outlets, the robot including handling means (12) suitable for extracting a tray from a recess of a sorting outlet and for placing it lengthwise on the tray conveyor.

10 Claims, 2 Drawing Sheets

(56) References Cited

FOREIGN PATENT DOCUMENTS

| | | | | | |
|---|---|---|---|---|---|
| WO | WO-2017051089 | A1 * | 3/2017 | ..... | B07C 3/02 |
| WO | 2017/162933 | A1 | 9/2017 | | |

* cited by examiner

MAIL SORTING INSTALLATION WITH A SHUTTLE ROBOT FOR INJECTING TRAYS ONTO A CONVEYOR

CROSS REFERENCE TO RELATED APPLICATIONS

This application is the U.S. National Stage of International Application Number PCT/FR2018/053220 filed on Dec. 12, 2018, which application claims priority under 35 USC § 119 to French Patent Application No. 1851194 filed on Feb. 13, 2018. Both applications are hereby incorporated by reference in their entirety.

TECHNICAL FIELD

The invention relates to the field of sorting mailpieces in trays in postal sorting centers.

More particularly, the invention relates to a sorting installation including sorting outlets aligned along a sorting conveyor, each outlet being provided with a recess for receiving a tray in which sorted mailpieces are stored, and also including a tray conveyor that extends in a certain conveying direction under said sorting outlets for the purpose of transporting trays filled with sorted mailpieces from the sorting outlets to a feed inlet of the sorting conveyor.

PRIOR ART

A sorting installation of that type is described, for example, in Document WO-A-01/12348.

Currently in postal sorting centers, trays filled with mailpieces are moved manually from sorting outlets to the tray conveyor by sorting operatives.

However, the arrangement of the sorting outlets above the tray conveyor and the orientation of the trays in the structures requires the operatives to extract the trays at arm's length and to turn them through 90° before placing them lengthwise on the tray conveyor.

That handling of trays is therefore often the cause of muscle or joint problems for operatives.

SUMMARY OF THE INVENTION

An object of the invention is therefore to remedy the above-mentioned problems.

To this end, the invention provides a sorting installation including sorting outlets aligned along a sorting conveyor, each outlet being provided with a recess for receiving a tray in which sorted mailpieces are stored, a tray conveyor that extends in a certain conveying direction under said sorting outlets for the purpose of transporting trays filled with sorted mailpieces from the sorting outlets to a feed inlet of the sorting conveyor, the installation being characterized in that it further includes a shuttle robot suitable for traveling on the floor in autonomous manner along the sorting outlets, said robot including handling means suitable for extracting a tray from a recess of a sorting outlet and for placing it on the tray conveyor, said handling means including a chute having a bottom end that is slidingly attached to said tray conveyor, said handling means being arranged so as to release the tray extracted from its recess onto the top portion of the chute in such a manner that the tray slides until it reaches the bottom portion of the chute under the effect of gravity, and in that the handling means include a motor-driven roller with a guide wheel that is arranged between the bottom portion of the chute and the tray conveyor and that is designed to drive the tray at the outlet of the chute onto the tray conveyor in a direction that is transverse to the conveyor direction in such a manner that the tray at the outlet of the chute is driven simultaneously by the guide wheel and by the tray conveyor in order to turn through 90° on the tray conveyor.

The idea forming the basis of the invention consists in automating the step of extracting trays from the sorting outlets and injecting them onto the tray conveyor.

In particular, the idea consists in using a chute to move a tray under the effect of gravity from a sorting outlet to the tray conveyor and to force the tray to turn through 90° at the outlet of the chute so as to orient the tray lengthwise on the tray conveyor.

In this example, the tray is turned by means of the guide wheel and the tray conveyor being driven simultaneously in two directions that are perpendicular to each other.

The sorting equipment of the invention may also have the following features:

- the guide wheel of the motor-driven roller is in alignment with the midline of the chute;
- the travel speed of the tray induced by the guide wheel is less than the travel speed of the tray induced by the tray conveyor;
- the motor-driven roller is designed to operate in reverse when turning of the tray is less than 90°;
- the shuttle robot includes a fixed flat guide wheel arranged between the motor-driven roller and the tray conveyor in order to cause the tray to pivot thereabout while it is turning;
- the shuttle robot includes a retractable flat guide wheel suitable for being deployed on the tray conveyor in order to cause the tray to pivot thereabout while it is turning.

In advantageous manner, the motor-drive unit of the roller with a guide wheel makes it possible, in this embodiment, to control the speed at which the tray is inserted onto the tray conveyor in such a manner that the travel speed of the tray over the guide wheel is constantly less than the travel speed of the tray on the tray conveyor.

The arrangement of the guide wheel of the motor-driven roller extending the midline of the chute also makes it possible to create a central bearing point under the tray, while the tray is in contact with the chute or with the tray conveyor at two bearing points.

The point of contact between the tray and the guide wheel thus makes it possible to balance the tray on the guide wheel in order to facilitate turning it through 90° at the outlet of the chute.

BRIEF DESCRIPTION OF THE DRAWINGS

The present invention can be better understood and other advantages appear on reading the following detailed description of the embodiment given by way of non-limiting example and with reference to the accompanying drawings, in which.

DESCRIPTION OF THE EMBODIMENT

Figure 1:
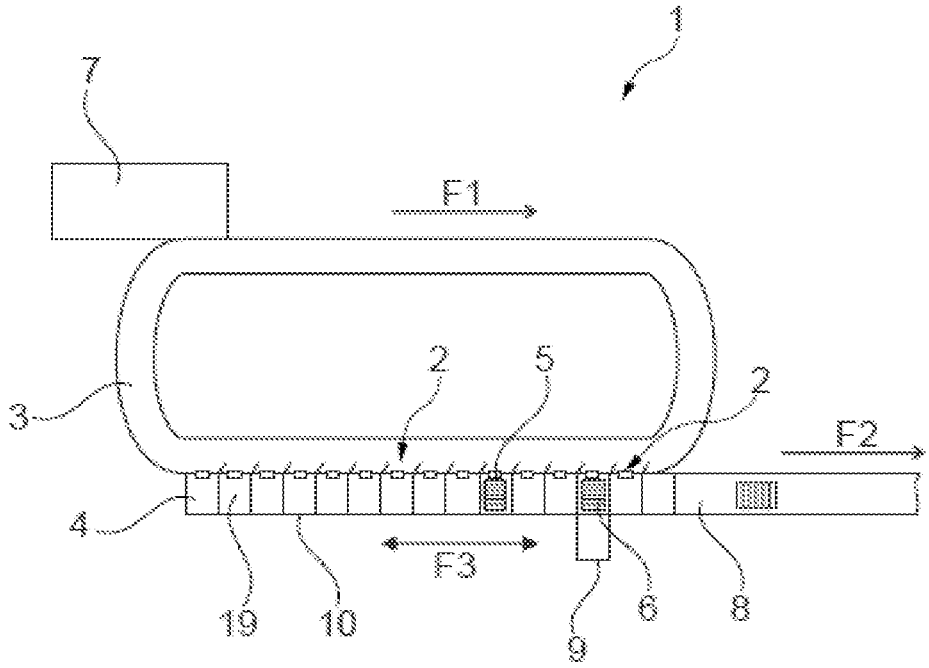
FIG. 1 is a diagrammatic view of the top of a sorting installation of the invention.

FIG. 1 shows a sorting installation 1 of the invention that includes sorting outlets 2 aligned along a sorting conveyor 3, each outlet being provided with a recess 4 for receiving a tray 5 in which sorted mailpieces 6 are stored.

FIG. 1 also shows a feed inlet 7 designed for putting mailpieces 6 in series on the sorting conveyor 3 in the conveying direction F1 for subsequent sorting into the corresponding sorting outlets 2.

A tray conveyor 8 is also provided under the sorting outlets 2 in order to convey the trays 5 filled with mailpieces 6 from the sorting outlets 2 to the feed inlet 7 in a conveying direction F2.

In this example, a tray 5 is extracted from a recess 4 of a sorting outlet 2 and is injected onto the tray conveyor 8 under said sorting outlet 2 by means of a shuttle robot 9 suitable for traveling on the floor S1 in autonomous manner along the sorting outlets 2 in the travel direction F3.

Figure 2:
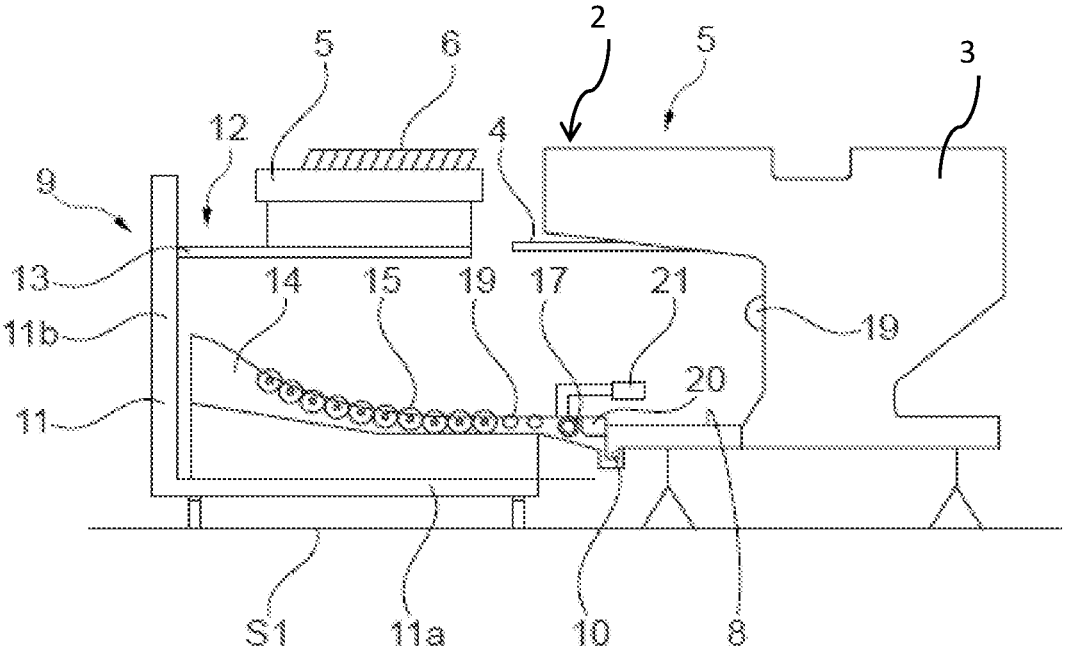
FIG. 2 is a diagram showing a shuttle robot in profile in front of a sorting outlet of the sorting installation of the invention.
Figure 3:
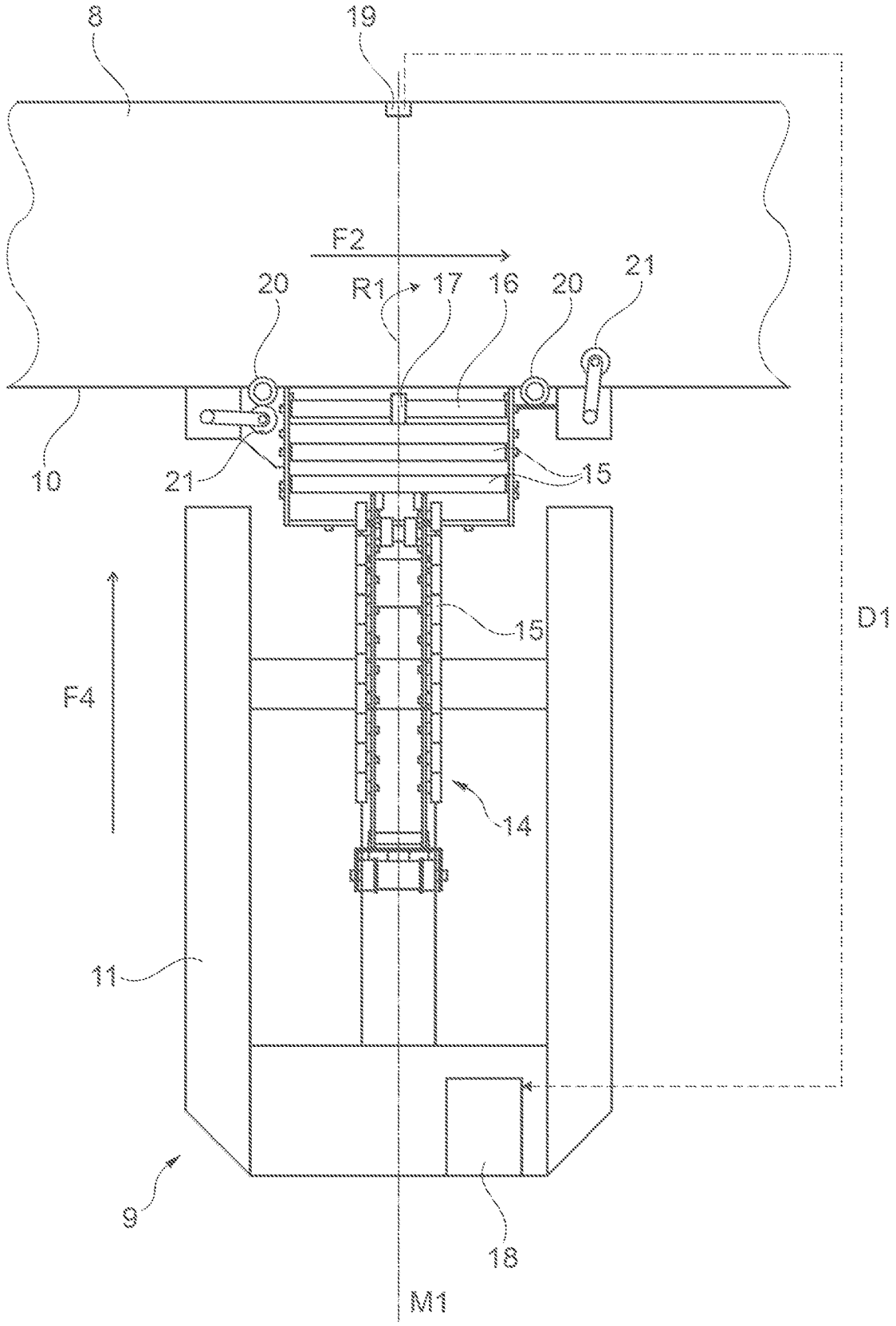
FIG. 3 is a diagram showing a shuttle robot of the sorting installation of the invention from above.

The shuttle robot 9 couples to a guide rail 10 in sliding manner that extends in front of the tray conveyor 8 over its entire length, as can be seen in FIGS. 1 to 3.

As shown in FIG. 2, the shuttle robot 9 comprises a structure 11, in this embodiment an L-shaped structure with a wheeled platform 11*a* and a back plate 11*b*, on which there are mounted handling means 12 suitable for extracting a tray from a recess of a sorting outlet and for placing it on the tray conveyor.

The handling means 12 include a motor-driven pickup head 13 comprising two horizontal parallel bars that are telescopic and movable vertically in order to extract a tray 5 from the recess 4 of a sorting outlet 2.

The handling means also include a tray chute 14 that extends under the telescopic head 13 in such a manner that the telescopic pickup head 13 moves downwards vertically in order to unload the tray onto the chute.

The slope of the chute 14 is therefore selected so that the trays 5 slide by gravity onto the tray conveyor 8.

The chute 14 could also be constituted by an alignment of rollers or guide wheels 15 mounted to be free to turn so as to facilitate sliding of the trays 5 and accept smaller gradients for the slope of the chute.

FIG. 3 shows the shuttle robot 9 of the invention without the pickup head 13 and in which the bottom end of its chute is provided with a motor-driven roller 16 with a guide wheel 17 that is interposed between the bottom end of the chute 14 and the rail 10 of the tray conveyor 8.

The guide wheel 17 in this embodiment is oriented perpendicularly to the conveyor 8, so as to move the tray 5 in a direction F4 that is transverse to the conveying direction F2, as shown in FIG. 3.

The diameter of the guide wheel 17 is in this embodiment greater than the diameter of the motor-driven roller 16, e.g. of the order of 1.5 to 2 times greater, so that the tray 5 moving on the guide wheel 17 is not in contact with the motor-driven roller 16.

It should thus be understood that any tray 5 having a bottom wall that is deformed by the way its load is distributed to the front or to the rear, e.g. having a bottom wall that bulges or that is twisted, can nevertheless be moved by the guide wheel 17.

The guide wheel 17 also presents a width that is smaller than the width of the tray 5 in such a manner that the tray 5 is in contact with the guide wheel 17 at a single bearing point.

In general, the guide wheel always presents a bearing surface area that is smaller than the bearing surface area of the tray on the chute 14 or on the tray conveyor 8.

As shown in FIG. 3, the guide wheel 17 is also placed extending the midline M1 of the chute so that the tray 5 sliding on the chute 14 is centered and balanced on the guide wheel 17.

Thus, at the outlet of the chute 14, the tray 5 initially has two bearing points against the chute 14 and a central bearing point against the guide wheel 17, then, once it is in contact with the tray conveyor, the tray 5 has two bearing points against the tray conveyor 8 and a central bearing point against the guide wheel 17.

When the tray 5 is being driven by the tray conveyor 8, the single bearing point against the guide wheel 17 moves under the tray 5 in order to unbalance the tray on the guide wheel 17 and encourage pivoting of the tray 5 in a 90° turning movement in the direction of arrow R1.

Thus, it should be understood that the friction forces of the tray 5 against the tray conveyor 8 and against the guide wheel 17 generate torque in order to turn the tray 5.

In order to guarantee good turning of the tray through 90° on the tray conveyor 8, the travel speed of the tray 5 induced by the guide wheel 17 should be less than the travel speed of the tray 5 induced by the tray conveyor 8.

Thus, in order to guarantee this speed differential, a monitoring and control unit 18 is installed on the shuttle robot 9 in order to control the speed of rotation of the guide wheel 17 using data such as the conveying speed of the tray conveyor 8, the filling distribution of the trays 5 with mailpieces stored towards the front or rear of the tray, and even the weight of the trays.

A cell 19, shown in FIGS. 1 to 3, suitable for detecting the position of a tray at the outlet of the chute 14 is also installed on the conveyor 8 under each sorting outlet 2.

In this embodiment, the cells 19 are designed to produce data about the position of the tray and to transmit it to the monitoring and control unit via wireless communication means represented by the dashed-line arrow D1.

Thus, if the tray 5 turns on the tray conveyor 8 by less than a certain threshold, the monitoring and control unit 18 causes the motor-driven roller 16 to reverse for a few seconds, e.g. in the range 3 to 5 seconds, so as to cause the tray to move backwards towards the chute.

Once that time period has passed, the monitoring and control unit 18 reestablishes forward drive of the motor-driven roller 16.

The back-and-forth movement of the tray on the guide wheel 17 is repeated as many times as necessary in order to guarantee that the tray performs a complete 90° turn.

The shuttle robot 9 also includes a fixed flat guide wheel 20 arranged between the motor-driven roller 16 and the tray conveyor 8 and a retractable flat guide wheel 21 suitable for being deployed on the tray conveyor 8.

In this embodiment, these wheels are designed to cause the tray 5 to pivot about them while it is turning, and also to prevent the tray from turning beyond 90°.

The retractable wheel 21 is deployed on the conveyor 8 downstream from the fixed wheel 20, which itself is downstream from the guide wheel 17 of the motor-driven roller 16 relative to the conveying direction F2.

If the conveying direction F2 is reversed, the monitoring and control unit 18 causes the retractable wheel 21 to be retracted away from the tray conveyor 8 so as not to disturb trays traveling on the tray conveyor and coming from upstream of the conveyor 8 in said reversed conveying direction.

It should be understood that the chute could be provided with a fixed wheel and with a retractable wheel at the upstream and downstream ends of the motor-driven roller relative to the conveying direction, in such a manner that the turning aid is effective in both directions of movement of the tray conveyor.

Without restricting the ambit of the invention, a plurality of shuttle robots 9 could be used along the tray conveyor 8 so as to accelerate the rate at which trays 5 are extracted from and injected onto the tray conveyor.

The invention claimed is:

1. A sorting installation comprising:

sorting outlets aligned along a sorting conveyor, each sorting outlet being provided with a recess for receiving a tray in which sorted mailpieces are stored, a tray conveyor that extends in a certain conveying direction under said sorting outlets for the purpose of transporting trays filled with sorted mailpieces in said conveying direction, a shuttle robot suitable for traveling on the floor in autonomous manner along the sorting outlets, said robot including handling means suitable for extracting a tray from a recess of a sorting outlet and for placing it on the tray conveyor, said handling means including a chute having a bottom end that is slidingly attached to said tray conveyor, said handling means being arranged so as to release the tray extracted from its recess onto the top portion of the chute in such a manner that the tray slides until it reaches the bottom portion of the chute under the effect of gravity, and in that the handling means include a motor-driven roller with a guide wheel that is arranged between the bottom portion of the chute and the tray conveyor and that is configured to drive the tray at the outlet of the chute onto the tray conveyor in a direction that is transverse to the conveying direction of the tray conveyor in such a manner that the tray at the outlet of the chute is driven simultaneously by the guide wheel and by the tray conveyor in order to turn through 90° on the tray conveyor.

2. The sorting installation according to claim 1, wherein said guide wheel of the motor-driven roller is in alignment with a midline of said chute.

3. The sorting installation according to claim 2, wherein the travel speed of the tray induced by said guide wheel is less than a travel speed of the tray induced by said tray conveyor.

4. The sorting installation according to claim 3, wherein said motor-driven roller is configured to operate in reverse when turning of the tray is less than 90°.

5. The sorting installation according to claim 4, wherein said shuttle robot includes a fixed flat guide wheel arranged between said motor-driven roller and said tray conveyor in order to cause the tray to pivot thereabout while it is turning.

6. The sorting installation according to claim 5, wherein said shuttle robot includes a retractable flat guide wheel suitable for being deployed on said tray conveyor in order to cause the tray to pivot thereabout while it is turning.

7. The sorting installation according to claim 1, wherein the travel speed of the tray induced by said guide wheel is less than a travel speed of the tray induced by said tray conveyor.

8. The sorting installation according to claim 1, wherein said motor-driven roller is configured to operate in reverse when turning of the tray is less than 90°.

9. The sorting installation according to claim 1, wherein said shuttle robot includes a fixed flat guide wheel arranged between said motor-driven roller and said tray conveyor in order to cause the tray to pivot thereabout while it is turning.

10. The sorting installation according to claim 9, wherein said shuttle robot includes a retractable flat guide wheel suitable for being deployed on said tray conveyor in order to cause the tray to pivot thereabout while it is turning.

* * * * *